US011008951B2

(12) United States Patent
Burns et al.

(10) Patent No.: US 11,008,951 B2
(45) Date of Patent: May 18, 2021

(54) LOW PRESSURE FUEL INJECTION SYSTEM FOR A MULTI-CYLINDER LIGHT-DUTY INTERNAL COMBUSTION ENGINE

(71) Applicant: Walbro LLC, Tucson, AZ (US)

(72) Inventors: Gary J. Burns, Millington, MI (US); William E. Galka, Caro, MI (US); Bradley J. Roche, Millington, MI (US); Albert L. Sayers, Caro, MI (US); David L. Speirs, Cass City, MI (US); Eric G. Zbytowski, Caro, MI (US)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 16/652,187

(22) PCT Filed: Oct. 2, 2018

(86) PCT No.: PCT/US2018/053895
§ 371 (c)(1),
(2) Date: Mar. 30, 2020

(87) PCT Pub. No.: WO2019/070656
PCT Pub. Date: Apr. 11, 2019

(65) Prior Publication Data

US 2020/0248635 A1 Aug. 6, 2020

Related U.S. Application Data

(60) Provisional application No. 62/566,587, filed on Oct. 2, 2017.

(51) Int. Cl.
*F02M 1/00* (2006.01)
*F02D 9/10* (2006.01)
(Continued)

(52) U.S. Cl.
CPC ..... *F02D 9/1095* (2013.01); *F02D 9/105* (2013.01); *F02D 9/1035* (2013.01);
(Continued)

(58) Field of Classification Search
CPC ..... F02M 35/10216; F02M 55/005; F02M 55/02; F02M 55/025; F02M 61/14; F02M 69/462; F02M 61/168
(Continued)

(56) References Cited

U.S. PATENT DOCUMENTS 3,887,661 A 6/1975 Ojala
4,039,638 A 8/1977 Hill
(Continued)

FOREIGN PATENT DOCUMENTS

WO WO2009042800 A2 4/2009

OTHER PUBLICATIONS

Written Opinion & International Search Report for PCT/US2018/053895 dated Feb. 1, 2019, 14 pages.

*Primary Examiner* — John Kwon
(74) *Attorney, Agent, or Firm* — Reising Ethington P.C.

(57) ABSTRACT

In at least some implementations, a throttle body assembly includes a body that has multiple throttle bores, multiple throttle valve heads received one in each of the throttle bores, at least one throttle valve shaft to which the throttle valve heads are coupled, and at least one of a fuel metering valve and a vapor separator carried by the body.

20 Claims, 10 Drawing Sheets

(51) Int. Cl.

| | |
|---|---|
| ***F02M 11/02*** | (2006.01) |
| ***F02M 17/42*** | (2006.01) |
| ***F02M 19/02*** | (2006.01) |
| ***F02M 35/10*** | (2006.01) |
| ***F02M 61/14*** | (2006.01) |

(52) U.S. Cl.
CPC ..... *F02D 9/1065* (2013.01); *F02M 11/02* (2013.01); *F02M 17/42* (2013.01); *F02M 19/0225* (2013.01); *F02M 35/10216* (2013.01); *F02M 61/145* (2013.01)

(58) Field of Classification Search
USPC ..... 123/445, 462, 468, 469
See application file for complete search history.

(56) References Cited

U.S. PATENT DOCUMENTS

| | | | | |
|---|---|---|---|---|
| 5,482,021 | A | 1/1996 | Roche | |
| 6,164,268 | A * | 12/2000 | Worth | F02M 67/02 123/533 |
| 6,386,186 | B1 * | 5/2002 | Coplin | F02B 61/045 123/521 |
| 6,394,426 | B1 | 5/2002 | Galka et al. | |
| 9,441,552 | B2 * | 9/2016 | Coplin | F02M 67/02 |
| 9,631,736 | B2 | 4/2017 | Kus et al. | |
| 2012/0227389 | A1 * | 9/2012 | Hinderks | F01L 1/146 60/317 |
| 2016/0305382 | A1 * | 10/2016 | Kim | F02M 61/12 |
| 2020/0063669 | A1 * | 2/2020 | Bleechmore | F02D 41/0002 |

* cited by examiner

LOW PRESSURE FUEL INJECTION SYSTEM FOR A MULTI-CYLINDER LIGHT-DUTY INTERNAL COMBUSTION ENGINE

REFERENCE TO RELATED APPLICATIONS

This application claims the benefit of U.S. Provisional Application Ser. No. 62/566,587 filed on Oct. 2, 2017 the entire contents of which are incorporated herein by reference in its entirety.

TECHNICAL FIELD

The present disclosure relates generally to a throttle body assembly including a low pressure fuel injection system for a multi-cylinder light-duty internal combustion engine.

BACKGROUND

Many engines utilize a throttle valve to control or throttle air flow to the engine in accordance with a demand on the engine. Such throttle valves may be used, for example, in throttle bodies of fuel injected engine systems. Many such throttle valves include a valve head carried on a shaft that is rotated to change the orientation of the valve head relative to fluid flow in a passage, to vary the flow rate of the fluid in and through the passage. In some applications, the throttle valve is rotated between an idle position, associated with low speed and low load engine operation, and a wide open or fully open position, associated with high speed and/or high load engine operation. Fuel may be provided from a relatively high pressure fuel injector (e.g. fuel pressure of 35 psi or more) for mixing with air to provide to the engine a combustible fuel and air mixture. The high pressure fuel injector is located downstream of the throttle body.

SUMMARY

In at least some implementations, a throttle body assembly includes a body that has multiple throttle bores, multiple throttle valve heads received one in each of the throttle bores, at least one throttle valve shaft to which the throttle valve heads are coupled, and at least one of a fuel metering valve and a vapor separator carried by the body.

Each valve head may be coupled to the same throttle valve shaft. Multiple fuel metering valves may be provided with one fuel metering valve provided for each throttle bore, and wherein each fuel metering valve may be electrically actuated. At least one fuel metering valve may be provided for each throttle bore, and the vapor separator may include an inlet chamber defined at least partially within the body and have an inlet in communication with a fuel supply and an outlet in communication with each fuel metering valve. The inlet chamber may include at least one outlet and each fuel metering valve may be communicated with at least one outlet of the inlet chamber. Fuel may flow from the inlet chamber to the fuel metering valves at a pressure equal to or below 6 psi. In at least some implementations, fuel flows from the inlet chamber to the fuel metering valves under the force of gravity.

The assembly may also include a vent valve having a closed position at least inhibiting flow therethrough and an open position in which gasses flow out of the inlet chamber. The assembly may further include a pressure sensor communicated with the inlet chamber and which is operable to provide a signal indicative of the pressure within the inlet chamber, and the vent valve may be electrically actuated and controlled at least in part as a function of the pressure within the inlet chamber.

An inlet valve may be provided that is movable between closed and open positions to selectively permit fuel to enter the inlet chamber when the inlet valve is in the open position, and a float may be coupled to the inlet valve. The float may be responsive to the level of liquid fuel to move the inlet valve to the closed position when a maximum fuel level is present within the inlet chamber. In at least some implementations, the inlet chamber is not completely full of liquid fuel at the maximum fuel level in the inlet chamber, leaving a space above the fuel level in which gasses are present. The inlet chamber may define or function as a fuel and vapor separator with liquid fuel being located in a gravitationally lower portion of the inlet chamber and gasses (e.g. air and fuel vapor) in a gravitationally upper portion of the inlet chamber.

The assembly may include at least one of an electrically controlled actuator that rotates the throttle valve shaft or a throttle position sensor that is responsive to the rotary position of the throttle valve shaft. When multiple throttle valve heads are carried by the same throttle valve shaft, a single actuator may rotate each valve head and/or a single position sensor may be used to determine the position of multiple throttle valves.

The assembly may include a boost venturi located within one of the multiple throttle bores, and liquid fuel may flow into the throttle bore through at least part of the boost venturi. An air induction passage may be communicated with at least one of multiple throttle bores and with at least one fuel metering valve to provide a gaseous flow (air and/or fuel vapor) that is mixed with fuel that flows through the fuel metering valve.

In at least some implementations, a manifold for an engine includes a body having an air/fuel passage through which fuel and air flow to the engine, and at least one of a fuel injector and a vapor separator carried by the body and through which liquid fuel is provided into the air/fuel passage. A vapor separator may be carried by the body and the vapor separator may include an inlet chamber defined at least partially within the body and have an inlet in communication with a fuel supply and an outlet through which fuel is supplied to the air/fuel passage. A fuel injector may be carried by the body and the fuel injector may have an inlet in communication with the inlet chamber and an outlet in communication with the air/fuel passage to provide fuel from the inlet chamber into the air/fuel passage when a valve of the fuel injector is in an open position. In at least some implementations, a throttle body is coupled to the body and has a throttle bore communicated with the air/fuel passage, and at least one throttle valve in the throttle bore to control air flow through the throttle bore.

In at least some implementations, an assembly to provide fuel to an engine includes a body adapted to be coupled to an intake manifold, the body including an air/fuel passage through which air flows to the intake manifold, a fuel injector carried by the body and communicated with the air/fuel passage to provide fuel into the air/fuel passage, and optionally, a fuel/vapor separator carried by the body and including a volume of fuel that is communicated with the fuel injector. In at least some implementations, a throttle body is located upstream of the body and has a throttle bore communicated with the air/fuel passage. The throttle body may include at least one throttle valve in the throttle bore to control air flow through the throttle bore whereby the air flow from the throttle bore is combined with fuel flow from the fuel injector in the air/fuel passage.

BRIEF DESCRIPTION OF THE DRAWINGS

The following detailed description of certain embodiments and best mode will be set forth with reference to the accompanying drawings, in which.

DETAILED DESCRIPTION

Figure 1:
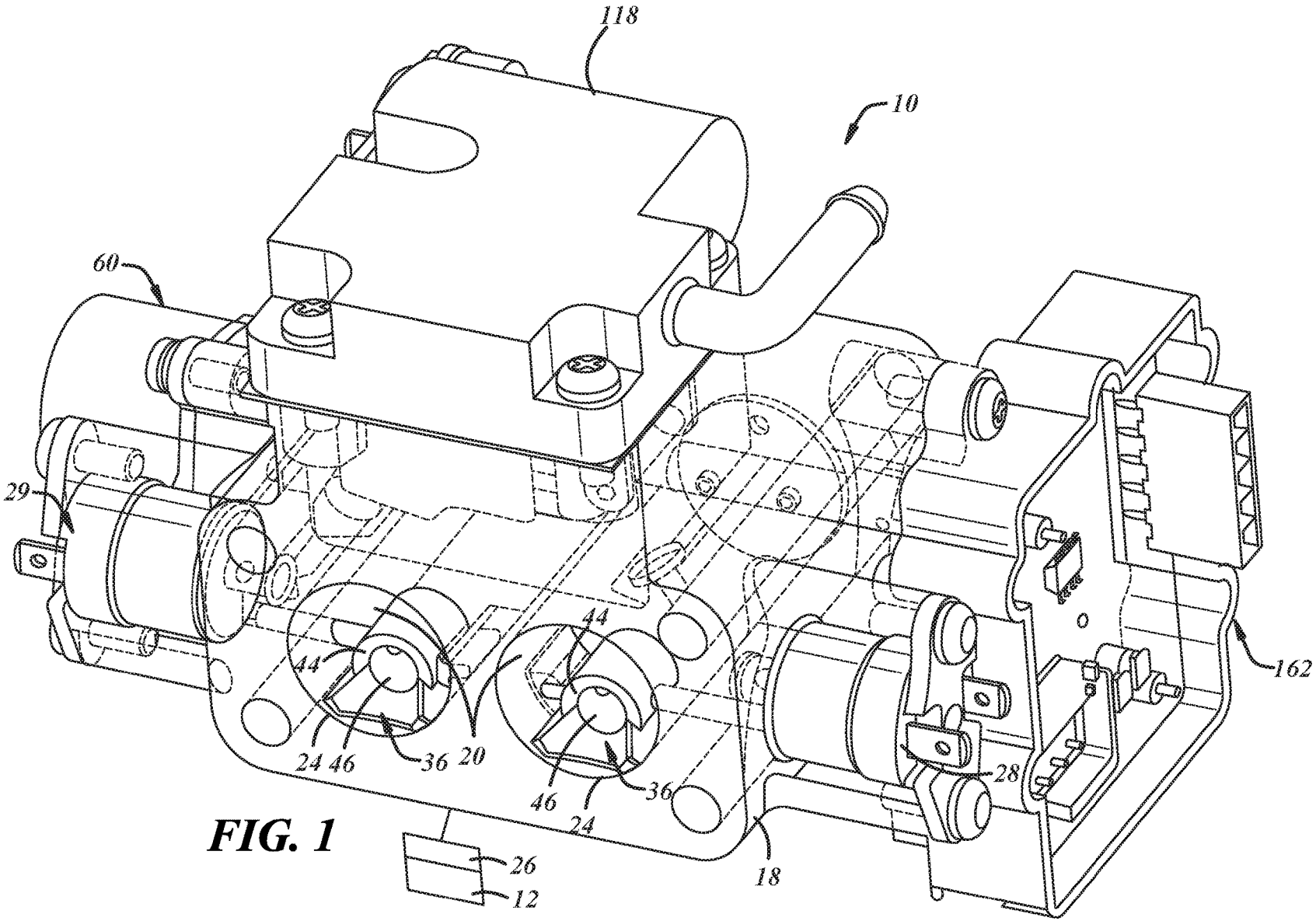
FIG. 1 is a perspective view of a throttle body assembly having multiple bores from which a fuel and air mixture may be delivered to an engine, a main body of the throttle body assembly is shown transparent to show certain internal components and features.
Figure 2:
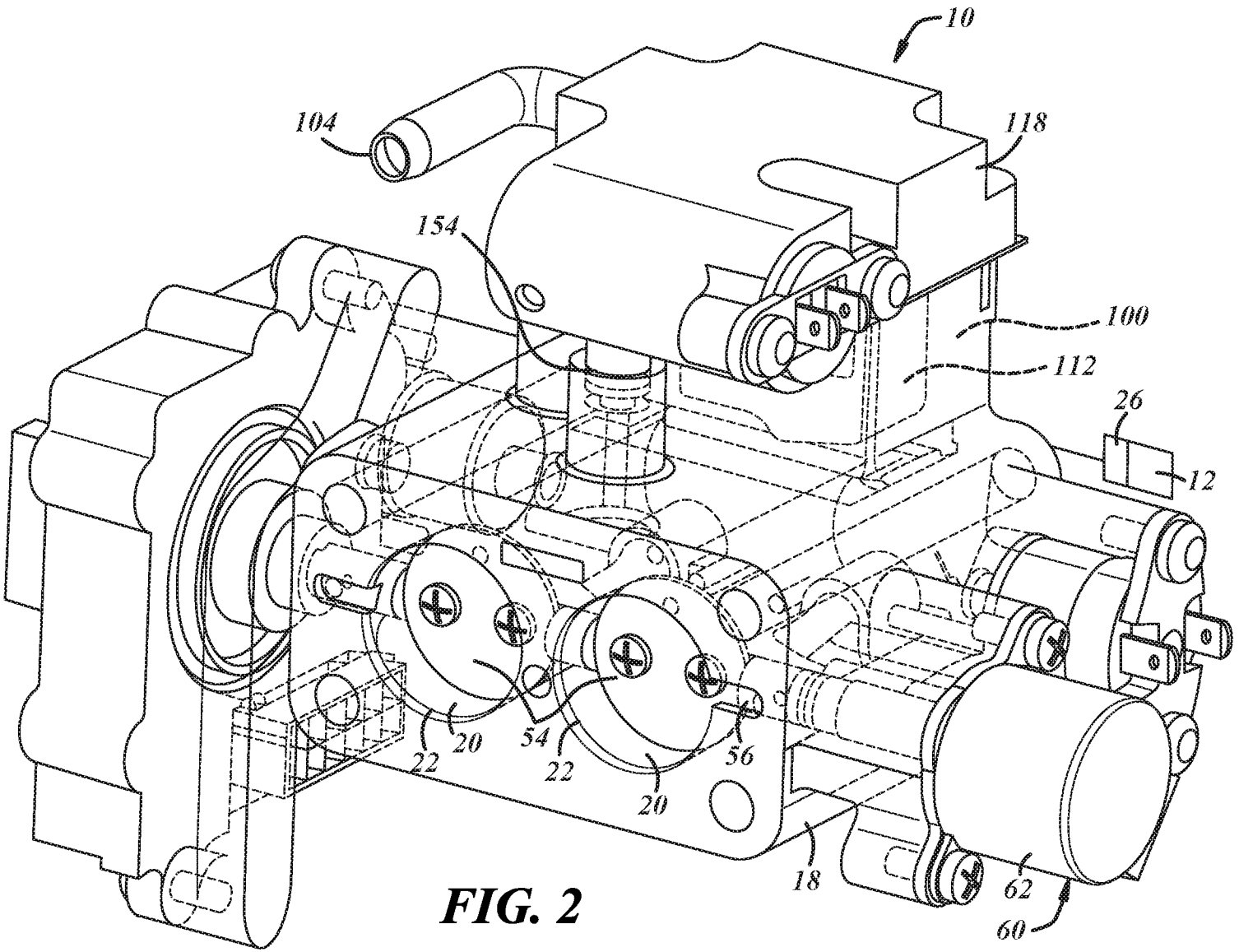
FIG. 2 is another perspective view of the throttle body assembly.
Figure 3:
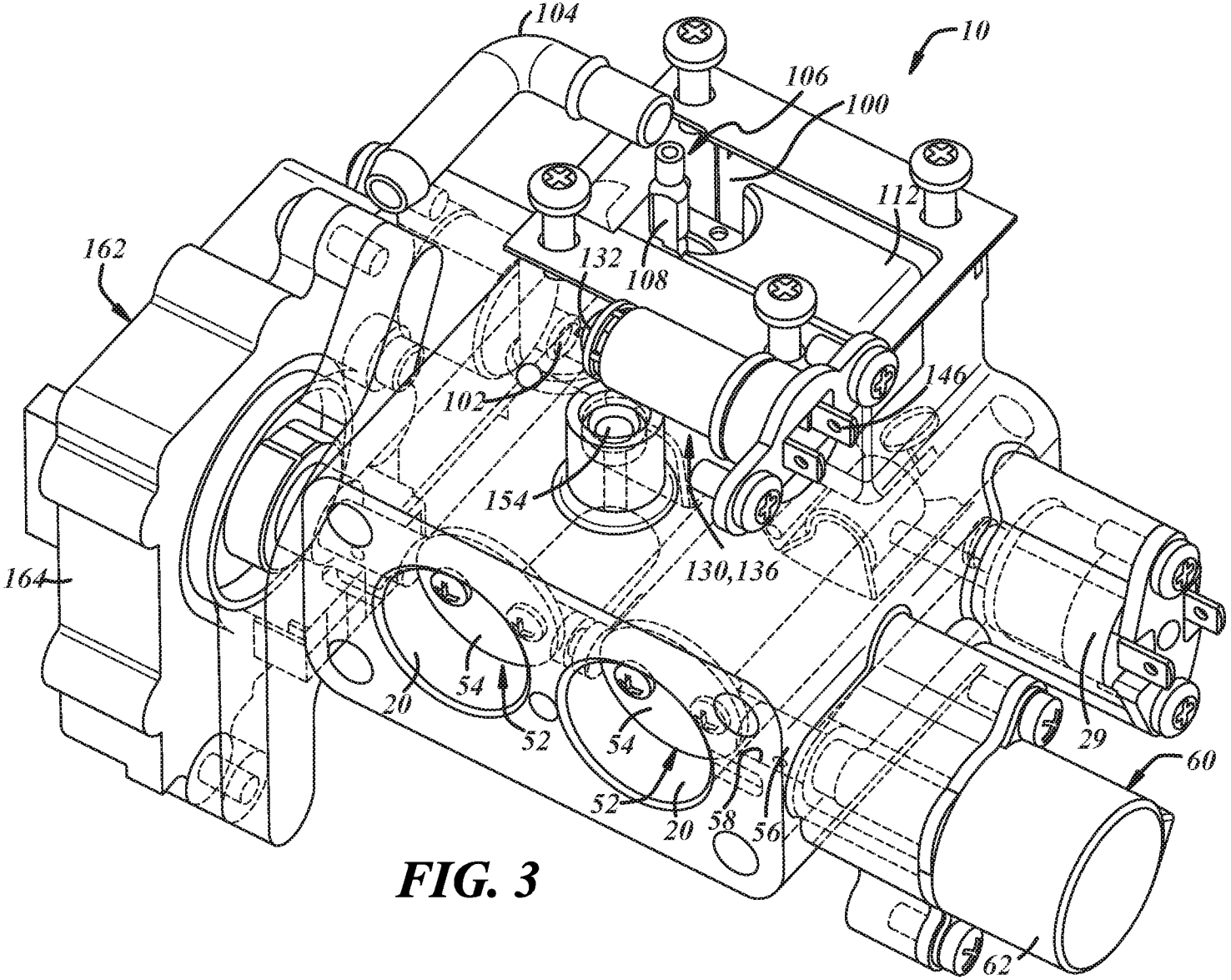
FIG. 3 is another perspective view of the throttle body assembly with a vapor separator cover removed.

Referring in more detail to the drawings, FIGS. 1-3 illustrate a charge forming device 10 that provides a combustible fuel and air mixture to an internal combustion engine 12 (shown schematically in FIG. 1) to support operation of the engine. The charge forming device 10 may be utilized on a two or four-stroke internal combustion engine, and in at least some implementations, includes a throttle body assembly 10 from which air and fuel are discharged for delivery to the engine.

The assembly 10 includes a housing having a throttle body 18 that has more than one throttle bore 20 (shown as two separate bores extending through the body parallel to each other) each having an inlet 22 (FIG. 2) through which air is received into the throttle bore 20 and an outlet 24 (FIG. 1) connected or otherwise communicated with the engine (e.g. an intake manifold 26 thereof). The inlets may receive air from an air filter (not shown), if desired, and that air may be mixed with fuel provided from separate fuel metering valves 28, 29 carried by or communicated with the throttle body 18. The intake manifold 26 generally communicates with a combustion chamber or piston cylinder of the engine during sequentially timed periods of a piston cycle. For a four-stroke engine application, as illustrated, the fluid may flow through an intake valve and directly into the piston cylinder. Alternatively, for a two-stroke engine application, typically air flows through the crankcase (not shown) before entering the combustion chamber portion of the piston cylinder through a port in the cylinder wall which is opened intermittently by the reciprocating engine piston.

Figure 4:
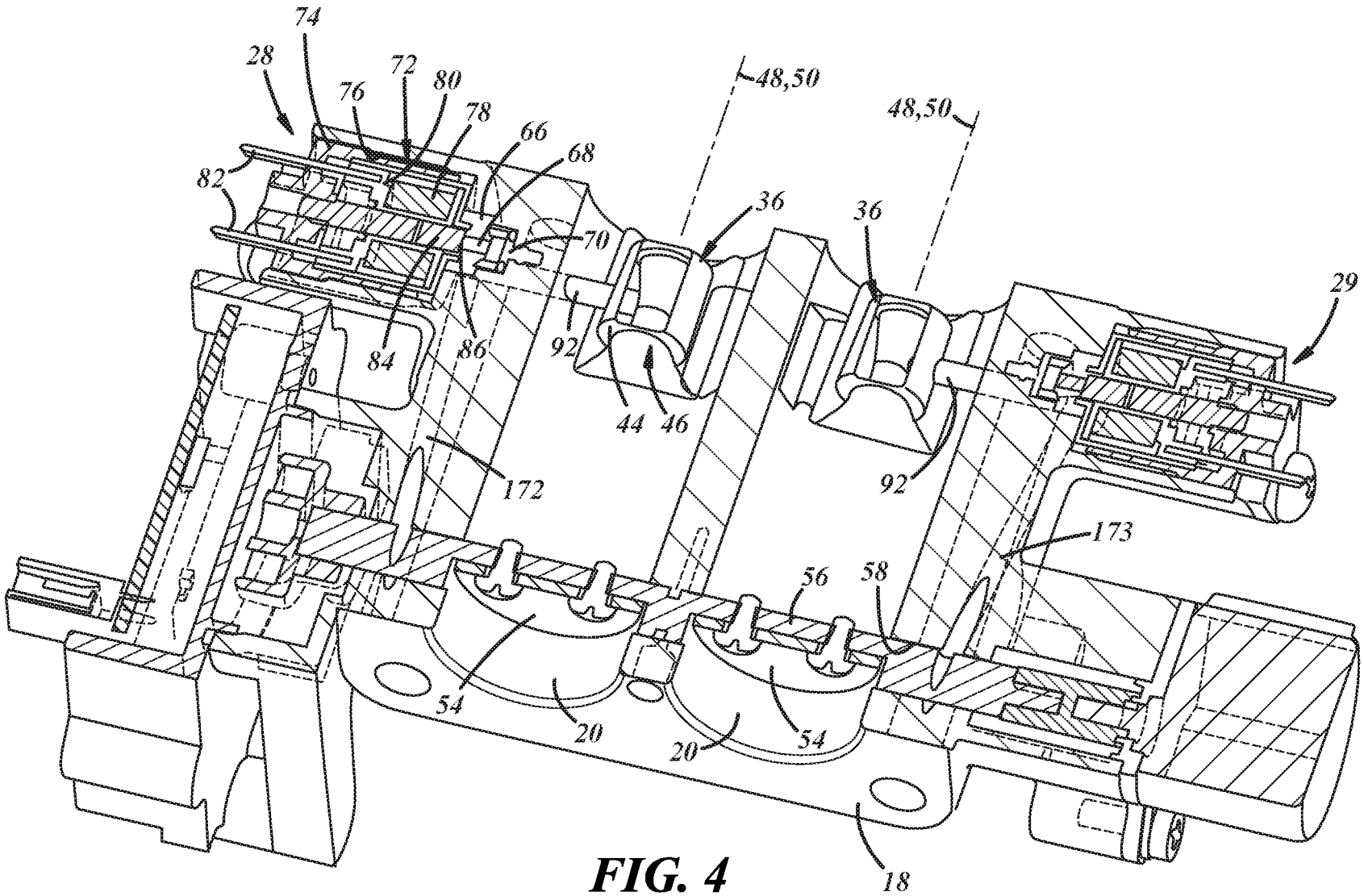
FIG. 4 is a perspective sectional view of a throttle body assembly.

The throttle bores 20 may have any desired shape including (but not limited to) a constant diameter cylinder or a venturi shape wherein the inlet leads to a tapered converging portion that leads to a reduced diameter throat that in turn leads to a tapered diverging portion that leads to the outlet 24. The converging portion may increase the velocity of air flowing into the throat and create or increase a pressure drop in the area of the throat. In at least some implementations, a secondary venturi, sometimes called a boost venturi 36 may be located within one or more of the throttle bores 20 whether the throttle bore 20 has a venturi shape or not. The boost venturis may be the same, if desired, and only one will be described further. The boost venturi 36 may have any desired shape, and as shown in FIGS. 1 and 4, has a converging inlet portion that leads to a reduced diameter intermediate throat that leads to a diverging outlet. The boost venturi 36 may be coupled the to throttle body 18 within the throttle bore 20, and in some implementations, the throttle body may be cast from a suitable metal and the boost venturi 36 may be formed as part of the throttle body, in other words, from the same piece of material cast as a feature of the throttle body when the remainder of the throttle body is formed. The boost venturi 36 may also be an insert coupled in any suitable manner to the throttle body 18 after the throttle body is formed. In the example shown, the boost venturi 36 includes a wall 44 that defines an inner passage 46 that is open at both its inlet and outlet to the throttle bore 20. A portion of the air that flows through the throttle body 18 flows into and through the boost venturi 36 which increases the velocity of that air and decreases the pressure thereof. The boost venturi 36 may have a center axis 48 (FIG. 4) that may be generally parallel to a center axis 50 (FIG. 4) of the throttle bore 20 and radially offset therefrom, or the boost venturi 36 may be oriented in any other suitable way.

Referring to FIG. 1, the air flow rate through the throttle bore 20 and into the engine is controlled at least in part by one or more throttle valves 52. In at least some implementations, the throttle valve 52 includes multiple heads 54 received one in each bore 20, each head may include a flat plate coupled to a rotating throttle valve shaft 56. The shaft 56 extends through a shaft bore 58 formed in the throttle body 18 that intersects and may be generally perpendicular to the throttle bores 20. The throttle valve 52 may be driven or moved by an actuator 60 between an idle position wherein the heads 54 substantially block air flow through the throttle bores 20 and a fully or wide-open position wherein the heads 54 provide the least restriction to air flow through the throttle bores 20. In one example, the actuator 60 may be an electrically driven motor 62 coupled to the throttle valve shaft 56 to rotate the shaft and thus rotate the valve heads 54 within the throttle bores 20. In another example, the actuator 60 may include a mechanical linkage, such as a lever attached to a throttle valve shaft 56 to which a Bowden wire may be connected to manually rotate the shaft 56 as desired and as is known in the art. In this way, multiple valve heads may be carried on a single shaft and rotated in unison within different throttle bores. A single actuator may drive the throttle valve shaft, and a single throttle position sensor may be used to determine the rotary position of the throttle valve (e.g. the valve heads 54 within the throttle bores 20).

The fuel metering valves 28 may be the same for each bore 20 and so only one is described further. The fuel metering valve 28 may have an inlet 66 to which fuel is delivered, a valve element 68 (e.g. a valve head) that controls fuel flow rate and an outlet 70 downstream of the valve element 68. To control actuation and movement of the valve element 68, the fuel metering valve 28 may include or be associated with an electrically driven actuator 72 such as (but not limited to) a solenoid. Among other things, the solenoid 72 may include an outer casing 74 received within a cavity 76 in the throttle body 18, a coil 78 wrapped around a bobbin 80 received within the casing 74, an electrical connector 82 arranged to be coupled to a power source to selectively energize the coil 78, and an armature 84 slidably received within the bobbin 80 for reciprocation between advanced and retracted positions. The valve element 68 may be carried by or otherwise moved by the armature 84 relative to a valve seat 86 that may be defined within one or both of the solenoid 72 and the throttle body 18. When the armature 84 is in its retracted position, the valve element 68 is removed or spaced from the valve seat 86 and fuel may flow through the valve seat. When the armature 84 is in its extended position, the valve element 68 may be closed against or bears on the valve seat 86 to inhibit or prevent fuel flow through the valve seat. In the example shown, the valve seat 86 is defined within the cavity 76 of the throttle body 18 and may be defined by a feature of the throttle body or by a component inserted into and carried by the throttle body or the solenoid casing 74. The solenoid 72 may be constructed as set forth in U.S. patent application Ser. No. 14/896,764. The inlet 68 may be centrally or generally coaxially located with the valve seat 86, and the outlet 70 may be radially outwardly spaced from the inlet and generally radially outwardly oriented. Of course, other metering valves, including but not limited to different solenoid valves or commercially available fuel injectors, may be used instead if desired in a particular application.

Fuel that flows through the valve seat 86 (e.g. when the valve element 68 is moved from the valve seat by retraction of the armature 84), flows to the metering valve outlet 70 for delivery into the throttle bore 20. In at least some implementations, fuel that flows through the outlet 70 is directed into the boost venturi 36, when a boost venturi 36 is included in the throttle bore 20. In implementations where the boost venturi 36 is spaced from the outlet 70, an outlet tube 92 (FIG. 4) may extend from a passage or port defining at least part of the outlet 70 and through an opening in the boost venturi wall 44 to communicate with the boost venturi passage 46. The tube 92 may extend into and communicate with the throat 40 of the boost venturi 36 wherein a negative or subatmospheric pressure signal may be of greatest magnitude, and the velocity of air flowing through the boost venturi 36 may be the greatest. Of course, the tube 92 may open into a different area of the boost venturi 36 as desired. Further, the tube 92 may extend through the wall 44 so that an end of the tube projects into the boost venturi passage 46, or the tube may extend through the boost venturi passage so that an end of the tube intersects the opposite wall of the boost venturi and may include holes, slots or other features through which fuel may flow into the boost venturi passage 46, or the end of the tube may be within the opening 94 and recessed or spaced from the passage (i.e. not protruding into the passage).

Figure 6:
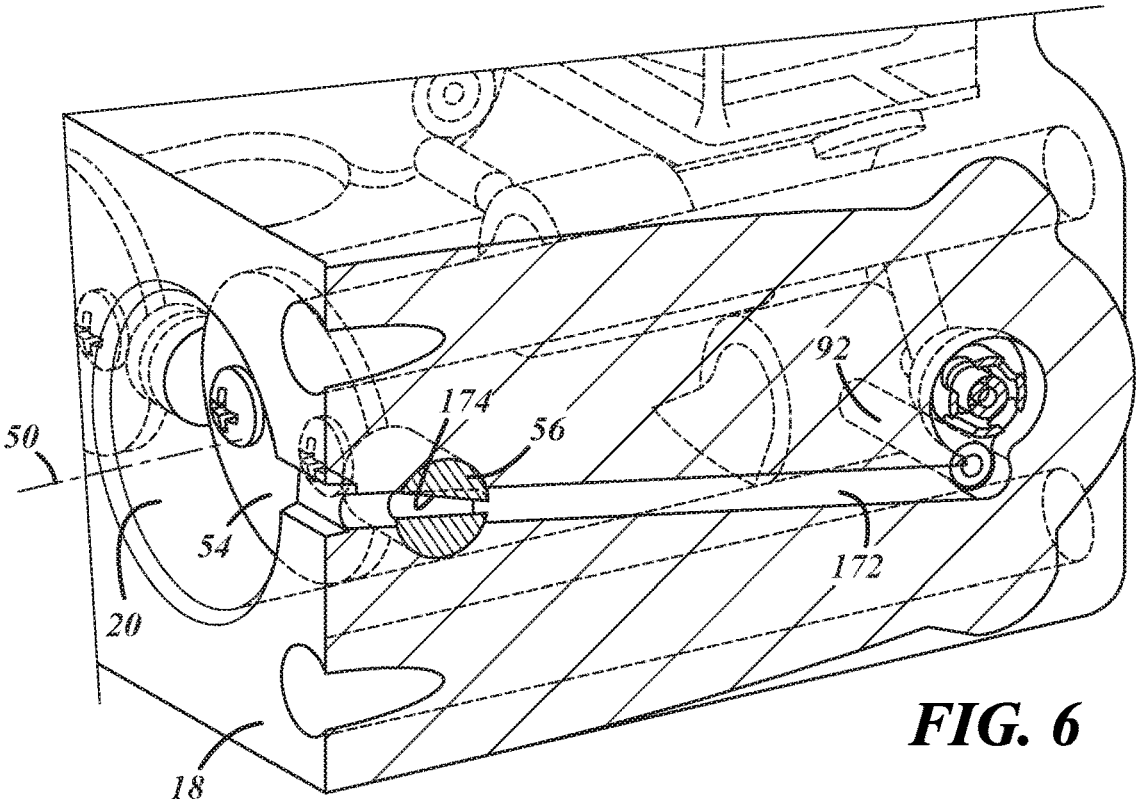
FIG. 6 is an enlarged, fragmentary perspective view of a portion of a throttle body assembly showing an air induction path and valve.

Further, as shown in FIGS. 4 and 6, air induction passages 172, 173 may be used with each or any one of multiple metering valves 28 when more than one metering valve is used. The air induction passages 172, 173 may extend from a portion of the throttle bores 20 upstream of the fuel outlet of the metering valve with which it is associated and may communicate with the fuel passage leading to the fuel outlet of the metering valve. In the example shown, the air induction passages 172, 173 lead from an inlet end 22 of the throttle body 18 and to the fuel outlet passages.

In the example where a fuel tube 92 extends into a boost venturi 36, the induction passages 172, 173 may extend into or communicate with the fuel tube (as shown in FIG. 6) to provide air from the induction passages and fuel from the metering valves 28 into the fuel tubes 92 where it may be mixed with air flowing through the throttle bores 20 and boost venturis 36.

A jet of other flow controller may be provided in the induction passages 172, 173 to control the flow rate of air in the passages, if desired. In addition to or instead of a jet or other flow controller, the flow rate through the induction passages 172, 173 may be controlled at least in part by a valve. The valve could be located anywhere along the passages 172, 173, including upstream of the inlet of the passages. In at least one implementation, the valve may be defined at least in part by the throttle valve shaft 56. In this example, the induction passage 172 intersects or communicates with the throttle shaft bore so that air that flows through the induction passages flows through the throttle shaft bore before the air is discharged into the throttle bore. Separate voids, like holes 174 or slots, may be formed in the throttle valve shaft 56 (e.g. through the shaft, or into a portion of the periphery of the shaft) and aligned with the passages 172, 173, as shown in FIG. 6. As the throttle valve shaft 56 rotates, the extent to which the void is aligned or registered with the induction passage changes. Thus, the effective or open flow area through the valve changes which may change the flow rate of air provided from the induction passage. If desired, in at least one position of the throttle valve, the voids may be not open at all to the induction passages such that air flow from the induction passages past the throttle valve bore does not occur or is substantially prevented. Hence, the air flow provided from the induction passages to the throttle bore may be controlled at least in part as a function of the throttle valve position.

Fuel may be provided from a fuel source to the metering valve inlet 66 and, when the valve element 68 is not closed on the valve seat 86, fuel may flow through the valve seat and the metering valve outlet 70 and to the throttle bore 20 to be mixed with air flowing therethrough and to be delivered as a fuel and air mixture to the engine. The fuel source may provide fuel at a desired pressure to the metering valve 28. In at least some implementations, the pressure may be ambient pressure or a slightly superatmospheric pressure up to about, for example, 6 psi above ambient pressure.

To provide fuel to the metering valve inlet 66, the throttle body assembly 10 may include an inlet chamber 100 (FIG. 3) into which fuel is received from a fuel supply, such as a fuel tank. The throttle body assembly 10 may include a fuel inlet 104 leading to the inlet chamber 100. In a system wherein the fuel pressure is generally at atmospheric pressure, the fuel flow may be fed under the force of gravity to the inlet chamber 100. In at least some implementations, as shown in FIGS. 3 and 4, a valve assembly 106 may control the flow of fuel into the inlet chamber 100. The valve assembly 106 may include a valve element 108 and may include or be associated with a valve seat so that a portion of the valve element 108 is selectively engageable with the valve seat to inhibit or prevent fluid flow through the valve seat, as will be described in more detail below. The valve element 108 may be coupled to an actuator 112 that moves the valve 108 relative to the valve seat, as will be set forth in more detail below. A vent port or passage 102 (FIGS. 4 and 5) may be communicated with the inlet chamber and with the engine intake manifold or elsewhere as desired so long as the desired pressure within the inlet chamber 100 is achieved in use, which may include atmospheric pressure. The level of fuel within the inlet chamber 100 provides a head or pressure of the fuel that may flow through the metering valve 28 when the metering valve is open.

To maintain a desired level of fuel in the inlet chamber 100, the valve 108 is moved relative to the valve seat by the actuator 112 which, in the example shown, includes or is defined by a float that is received in the inlet chamber and is responsive to the level of fuel in the inlet chamber. The float 112 may be buoyant in fuel and provide a lever pivotally coupled to the throttle body 18 or a cover 118 coupled to the body 18 on a pin and the valve 108 may be connected to the float 112 for movement as the float moves in response to changes in the fuel level within the inlet chamber 100. When a desired maximum level of fuel is present in the inlet chamber 100, the float 112 has been moved to a position in the inlet chamber wherein the valve 108 is engaged with and closed against the valve seat, which closes the fuel inlet 104 and prevents further fuel flow into the inlet chamber 100. As fuel is discharged from the inlet chamber 100 (e.g. to the throttle bore 20 through the metering valve 28), the float 112 moves in response to the lower fuel level in the inlet chamber and thereby moves the valve 108 away from the valve seat so that the fuel inlet 104 is again open. When the fuel inlet 104 is open, additional fuel flows into the inlet chamber 100 until a maximum level is reached and the fuel inlet 104 is again closed.

The inlet chamber 100 may be defined at least partially by the throttle body 18, such as by a recess formed in the throttle body, and a cavity in the cover 118 carried by the throttle body and defining part of the housing of the throttle body assembly 10. Outlets 120 (FIG. 5) of the inlet chamber 100 leads to the metering valve inlet 66 of each metering valve 28, 29. So that fuel is available at the metering valve 28 at all times when fuel is within the inlet chamber 100, the outlet 120 may be an open passage without any intervening valve, in at least some implementations. The outlet 120 may extend from the bottom or a lower portion of the inlet chamber so that fuel may flow under atmospheric pressure to the metering valve 28.

In use of the throttle body assembly 10, fuel is maintained in the inlet chamber 100 as described above and thus, in the outlet 120 and the metering valve inlet 66. When the metering valve 28 is closed, there is no, or substantially no, fuel flow through the valve seat 86 and so there is no fuel flow to the metering valve outlet 70 or to the throttle bore 20. To provide fuel to the engine, the metering valve 28 is opened and fuel flows into the throttle bore 20, is mixed with air and is delivered to the engine as a fuel and air mixture. The timing and duration of the metering valve opening and closing may be controlled by a suitable microprocessor or other controller. The fuel flow (e.g. injection) timing, or when the metering valve 28 is opened during an engine cycle, can vary the pressure signal at the outlet 70 and hence the differential pressure across the metering valve 28 and the resulting fuel flow rate into the throttle bore 20. Further, both the magnitude of the engine pressure signal and the airflow rate through the throttle valve 52 change significantly between when the engine is operating at idle and when the engine is operating at wide open throttle. In conjunction, the duration that the metering valve 28 is opened for any given fuel flow rate will affect the quantity of fuel that flows into the throttle bore 20.

The inlet chamber 100 may also serve to separate liquid fuel from gaseous fuel vapor and air. Liquid fuel will settle into the bottom of the inlet chamber 100 and the fuel vapor and air will rise to the top of the inlet chamber where the fuel vapor and air may flow out of the inlet chamber through the vent passage 102 or vent outlet (and hence, be delivered into the intake manifold and then to an engine combustion chamber). To control the venting of gasses from the inlet chamber 100, a vent valve 130 may be provided at the vent passage 102. The vent valve 130 may include a valve element 132 that is moved relative to a valve seat to selectively permit fluid flow through the vent or vent passage 102. To permit further control of the flow through the vent passage 102, the vent valve 130 may be electrically actuated to move the valve element 132 between open and closed positions relative to the valve seat 134.

Figure 5:
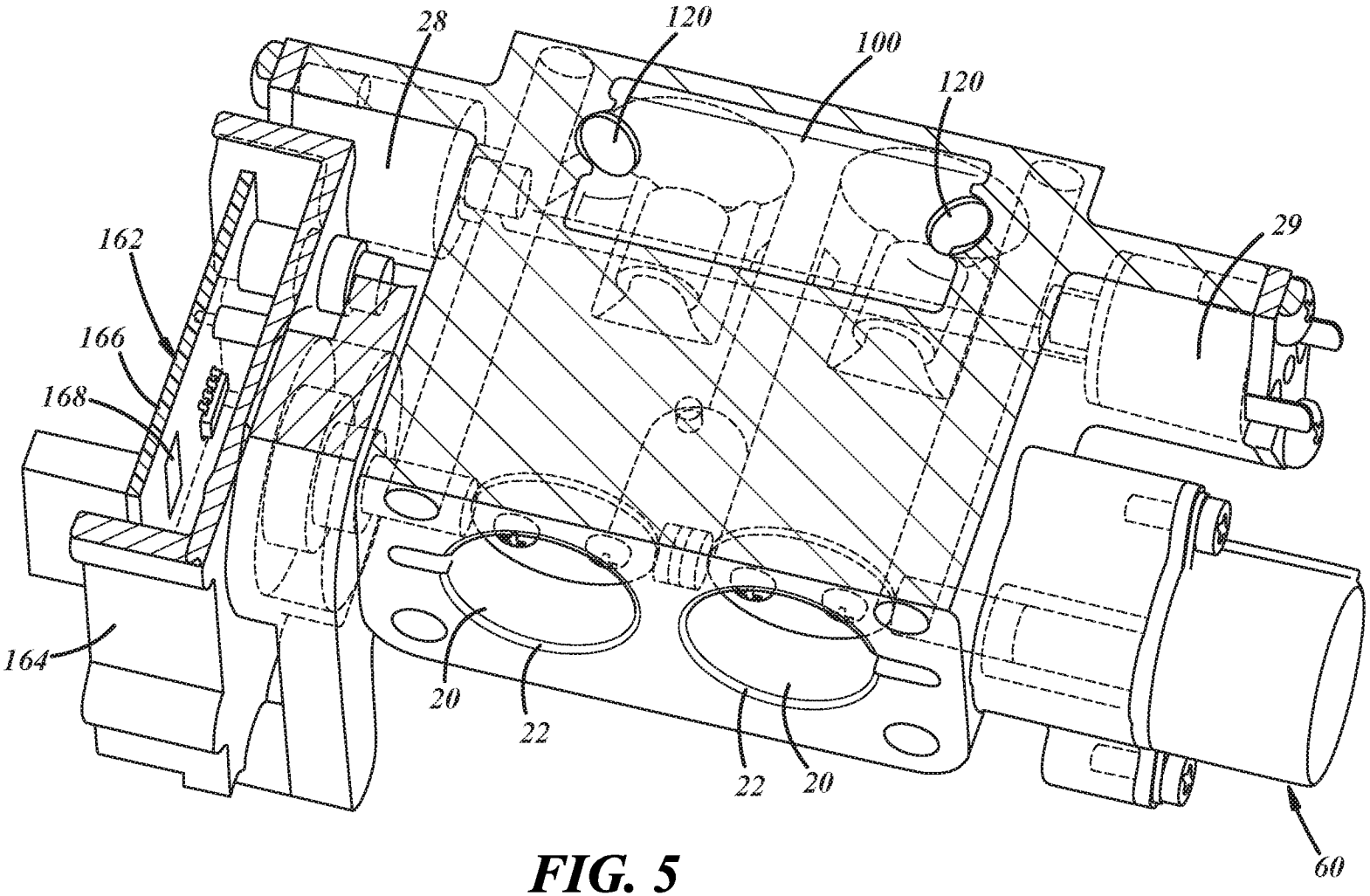
FIG. 5 is a perspective sectional view of a throttle body assembly.

As shown in FIGS. 4 and 5, to control actuation and movement of a valve element 132, the vent valve 130 may include or be associated with an electrically driven actuator such as (but not limited to) a solenoid 136. Among other things, the solenoid 136 may include an outer casing received within a cavity in the throttle body 18 or cover 118 and retained therein by a retaining plate or body, a coil wrapped around a bobbin received within the casing, an electrical connector 146 arranged to be coupled to a power source to selectively energize the coil, an armature slidably received within the bobbin for reciprocation between advanced and retracted positions and an armature stop. The valve element 132 may be carried by or otherwise moved by the armature relative to a valve seat that may be defined within one or more of the solenoid 136, the throttle body 18 and the cover 118. When the armature is in its retracted position, the valve element 132 is removed or spaced from the valve seat and fuel may flow through the valve seat. When the armature 148 is in its extended position, the valve element 132 may be closed against or bears on the valve seat 134 to inhibit or prevent fuel flow through the valve seat. The solenoid 136 may be constructed as set forth in U.S. patent application Ser. No. 14/896,764. Of course, other valves, including but not limited to different solenoid valves (including but not limited to piezo type solenoid valves) or other electrically actuated valves may be used instead if desired in a particular application.

The vent passage 102 or vent outlet could be coupled to a filter or vapor canister that includes an adsorbent material, such as activated charcoal, to reduce or remove hydrocarbons from the vapor. The vent passage 102 could also or instead be coupled to an intake manifold of the engine where the vapor may be added to a combustible fuel and air mixture provided from the throttle bore 20. In this way, vapor and air that flow through the vent valve 130 are directed to a downstream component as desired. In the implementation shown, an outlet passage 154 extends from the cover 118 downstream of the valve seat 134 and to an intake manifold of the engine (e.g. via the throttle bores 20). While the outlet passage 154 is shown as being defined at least in part in a conduit that is routed outside of the cover 118 and throttle body 18, the outlet passage 154 could instead be defined at least in part by one or more bores or voids formed in the throttle body and/or cover, and or by a combination of internal voids/passages and external conduit(s).

In at least some implementations, the cover 118 defines part of the inlet chamber 100 and the vent passage 102 extends at least partially within the cover and communicates at a first end with the inlet chamber 100 and at a second end with an outlet from the throttle body (e.g. the cover). The vent valve 130 and valve seat 132 are disposed between the first and second ends of the vent passage 102 so that the vent valve controls the flow through the vent passage. In the implementation shown, the vent passage 102 is entirely within the cover 118, and the vent valve 130 is carried by the cover, e.g. within the cavity formed in the cover.

In at least some implementations, a pressure in the vent passage 102 can interfere with the fuel flow from the inlet chamber 100 to the fuel metering valve 28 and throttle bore 20. For example, when the vent passage 102 is communicated with the intake manifold or with an air cleaner box/filter, a subatmospheric pressure may exist within the vent passage. The subatmospheric pressure, if communicated with the inlet chamber 100, can reduce the pressure within the inlet chamber and reduce fuel flow from the inlet chamber. Accordingly, closing the vent valve 130 can inhibit or prevent communication of the subatmospheric pressure from the vent passage 102 with the inlet chamber 100. A pressure sensor responsive to pressure in the vent passage 102 or in, for example, the intake manifold, may provide a signal that is used to control, at least in part, the actuation of the vent valve 130 as a function of the sensed pressure to improve control over the pressure in the inlet chamber. Also or instead, the vent valve 130 may be closed to permit some positive, superatmospheric pressure to exist within the inlet chamber 100 which may improve fuel flow from the inlet chamber to the throttle bore 20. And the vent valve 130 may be opened to permit engine pressure pulses (e.g. from the intake manifold) to increase the pressure within the inlet chamber 100. As noted above, the opening of the vent valve 130 may be timed with such pressure pulses by way of a pressure sensor or otherwise. These examples permit better control over the fuel flow from the inlet chamber 100 and thus, better control of the fuel and air mixture delivered from the throttle bore 20. In this way, the vent valve 130 may be opened and closed as desired to vent gasses from the inlet chamber 100 and to control the pressure within the inlet chamber.

Still further, it may be desirable to close the vent passage 102 to avoid the fuel in the inlet chamber 100 from going stale over time (due to evaporation, oxidation or otherwise), such as during storage of the device with which the throttle body assembly 10 is used. In this way, the vent valve 130 may be closed when the device is not being used to reduce the likelihood or rate at which the fuel in the throttle body assembly 10 becomes stale.

Finally, when the vent valve strokes from open to closed, the armature and valve element 132 movement displace air/vapor in the vent passage 102 toward and into the inlet chamber 100 which may raise the pressure in the inlet chamber. Repeated actuations of the vent valve 130 may then provide some pressure increase, even if relatively small, that facilitates fuel flow from the inlet chamber 100 to the throttle bore 20.

In at least some implementations, the pressure within the inlet chamber 100 may be controlled by actuation of the vent valve 130, to be between 0.34 mmHg to 19 mmHg. In at least some implementations, the vent valve 130 may be opened and closed repeatedly with a cycle time of between 1.5 ms to 22 ms. And in at least some implementations, the vent valve 130 may be controlled at least when the throttle valve is at least 50% of the way between its idle and wide open positions (e.g. between 50% and 100% of the angular rotation from idle to wide open), for example, because the intake manifold pressure may be greater in that throttle position range and thus, more likely to interfere with the pressure in the inlet chamber.

The vent valve 130 may be actuated by a controller 162 (FIGS. 1, 4 and 5) that controls when electrical power is supplied to the solenoid 136. The controller 162 may be the same controller that actuates the fuel metering valve 28 or a separate controller. Further, the controller 162 that actuates one or both of the vent valve 130 and the fuel metering valve 28 may be mounted on or otherwise carried by the throttle body assembly 10, or the controller may be located remotely from the throttle body assembly, as desired. In the example shown, the controller 162 is carried within a sub-housing 164 that is mounted to the throttle body 18 and/or cover 118, or otherwise carried by the housing (e.g. the body and/or cover), and which may include a printed circuit board 166 and a suitable microprocessor 168 or other controller for actuation of the metering valve 28, vent valve 130 and/or the throttle valve (e.g. when rotated by a motor 62 as shown and described above). Further, information from one or more sensors maybe used to control, at least in part, operation of the vent valve, and the sensor(s) may be communicated with the controller that controls actuation of the vent valve.

The dual bore throttle body and fuel injection assembly may be used to provide a combustible fuel and air mixture to a multi-cylinder engine. The assembly may improve cylinder to cylinder air-fuel ratio balancing, engine starting, and overall run quality and performance compared to an assembly having a single throttle bore and a single fuel injector or point/location of fuel injection.

The system or assembly may include a low pressure fuel injection system described above with the any following additional options: a single throttle body assembly with a plurality of throttle bores; one or more vapor separators integrated into the throttle body assembly; at least one injector per throttle bore; optional boost venturi for the injector(s); a single engine control module/controller; a single throttle shaft including multiple throttle valve heads on the shaft, one in each throttle bore; a single throttle position sensor; may include a single throttle actuator which may be electronically controlled; may include two ignition coils or a double-ended ignition coil.

Figure 9:
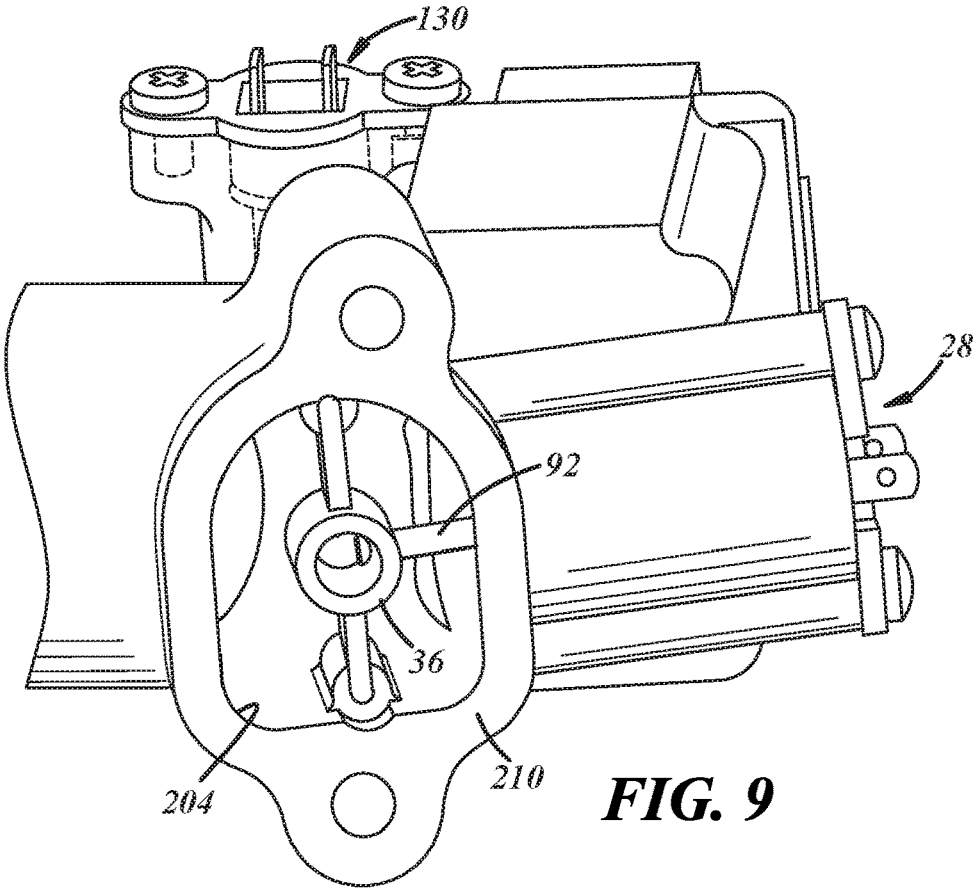
FIG. 9 is another sectional view of the intake manifold.
Figure 7:
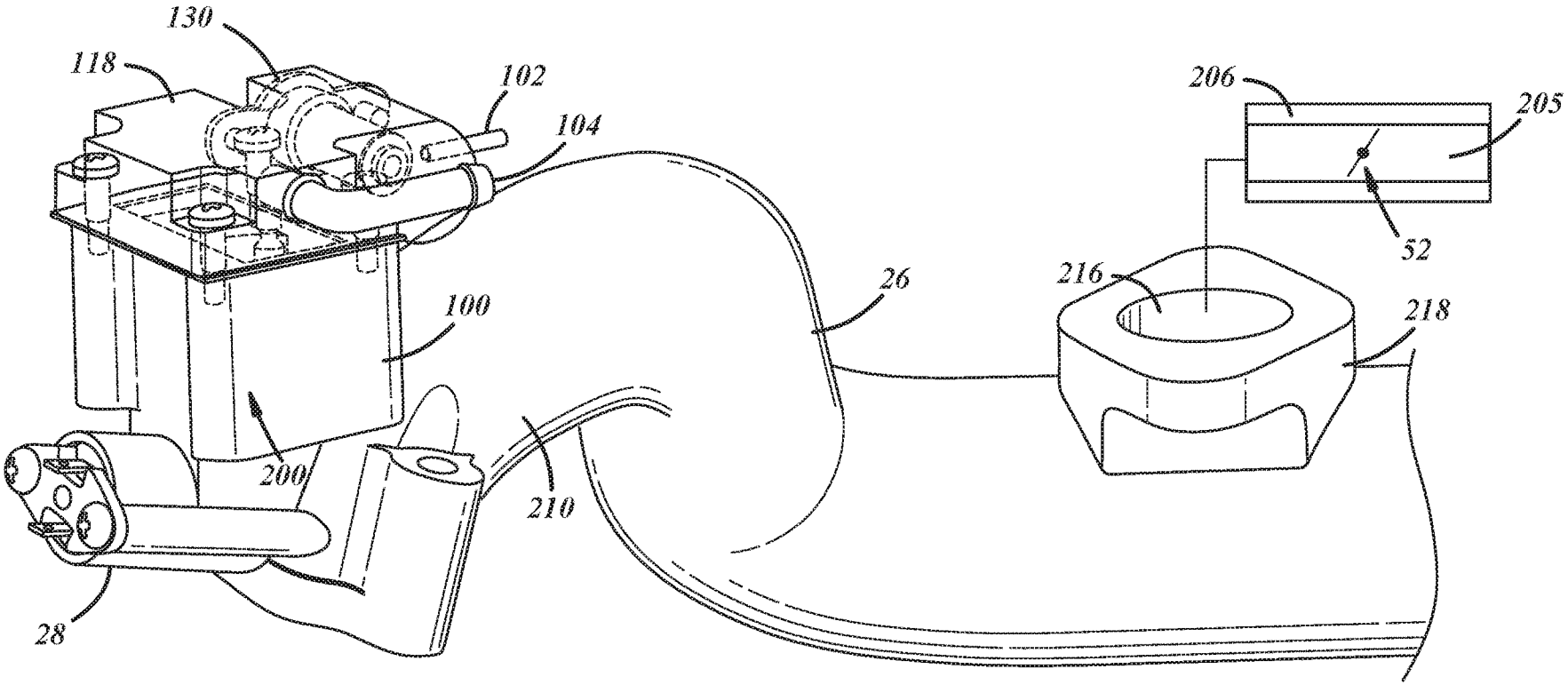
FIG. 7 is a perspective view of an intake manifold with an integrate vapor separator and fuel injection assembly.
Figure 8:
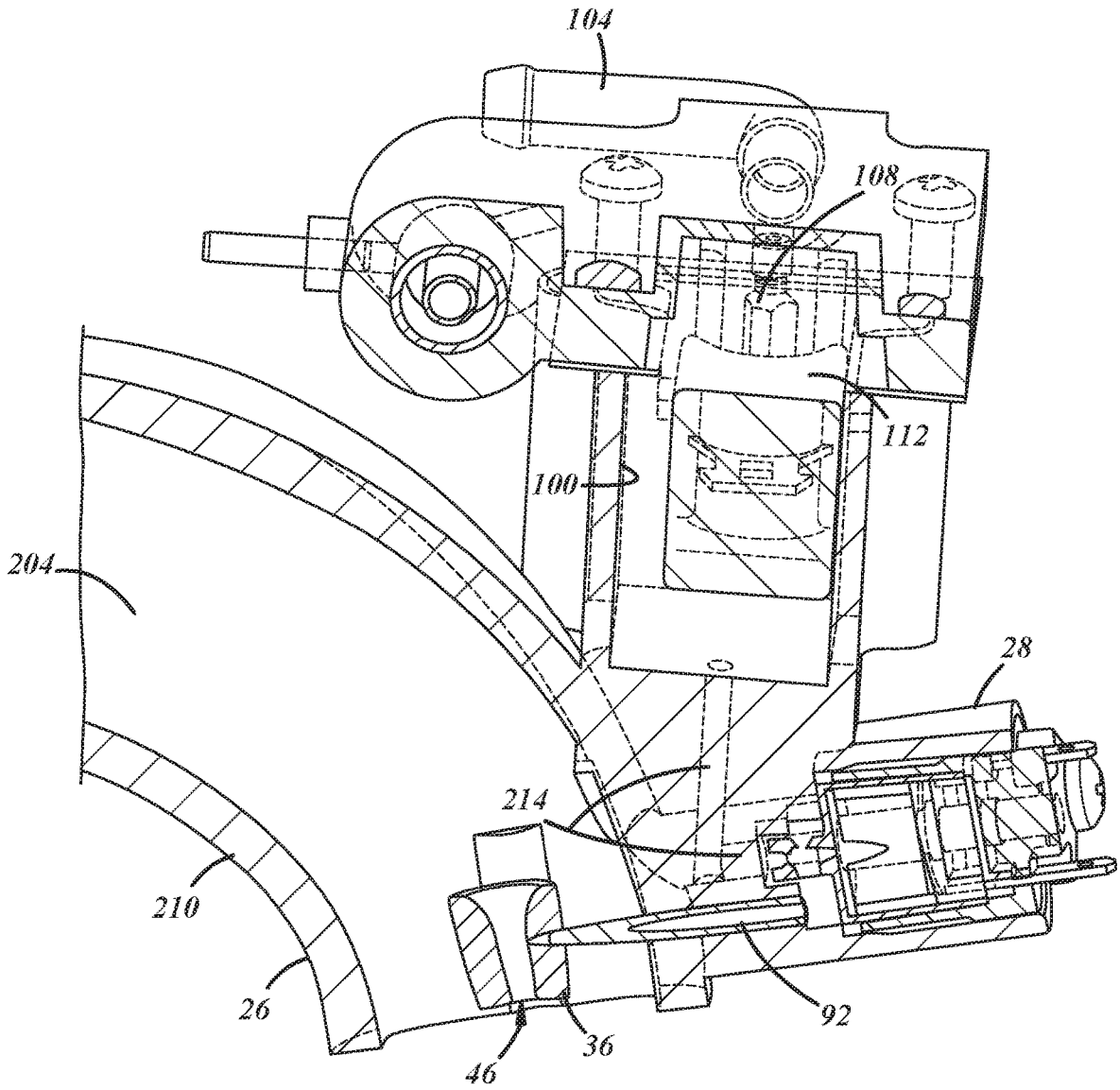
FIG. 8 is a sectional view of the intake manifold.

In another example, as shown in FIGS. 7-9, a vapor separator 200 and at least one fuel injector (e.g. fuel metering valve 28) per intake runner or air/fuel passage 204 of an intake manifold 26, may be integrated into the intake manifold 26. These components may be located downstream of one or more throttle valves 52 (FIG. 7) which may be carried in a throttle bore 205 of a throttle body 206 and through which air flow is controlled by one or more throttle valve(s) as set forth above. Thus, in this example, air flow may be controlled by the throttle body 206 which, in at least some implementations, does not also provide fuel into that air flow in the throttle bore 205. Instead, the fuel is provided at and through the intake manifold 26 which includes or to which is mounted the vapor separator 200 inclusive of the inlet chamber 100, inlet valve 106, vent valve 130 and all related components, as well as one or more metering valves 28.

The intake manifold 26 may include one air/fuel passage 204 for each cylinder of an engine or one air/fuel passage may provide air and fuel to multiple engine cylinders, as desired. A boost venturi 36 may optionally be provided in one or more air/fuel passages 204 and communicated with one or more fuel injectors 28, as desired, to encourage fuel flow from the fuel injector and into the air/fuel passage through the boost venturi, as set forth above with regard to the throttle body. The intake manifold 26 includes a body 210 that defines the passage(s) 204 through which a fuel and air mixture is delivered to the engine.

The vapor separator 200 and fuel injector(s) 28 may be carried by and fixed to the intake manifold body 210. The inlet chamber 100 may be defined at least in part by a cavity or void in the intake manifold body 210 and/or by a cover 118 of the vapor separator. And the fuel metering valve(s) 28 may be received at least partially within a void or cavity formed in the intake manifold body 210.

Fuel passage(s) 214 formed in the intake manifold body 210 may route fluids within and through the intake manifold 26 from the inlet chamber 100 to the fuel metering valve, and from the fuel metering valve into the air/fuel passage(s) 204 of the intake manifold, and may include an outlet tube 92 as set forth above or a different passage, although fuel may flow directly into the air/fuel passage 204 after exiting the fuel metering valve 28.

Thus, the intake manifold 26 includes the components that provide and meter fuel flow while an upstream throttle body 206 provides and meters air flow, to achieve the functionality described above with regard to the throttle body 206, but with the exception that the throttle valves 52 may be separately provided upstream of the manifold body 210 and fuel injector(s) 28. As shown in FIG. 7, the intake manifold body 210 may include a portion with an inlet 216 and a mount 218 which may be defined by a wall enclosing at least part of the inlet 216, to which a throttle body may be mounted, with air flowing through the throttle body entering the air/fuel passage 204 at the inlet 216.

Figure 10:
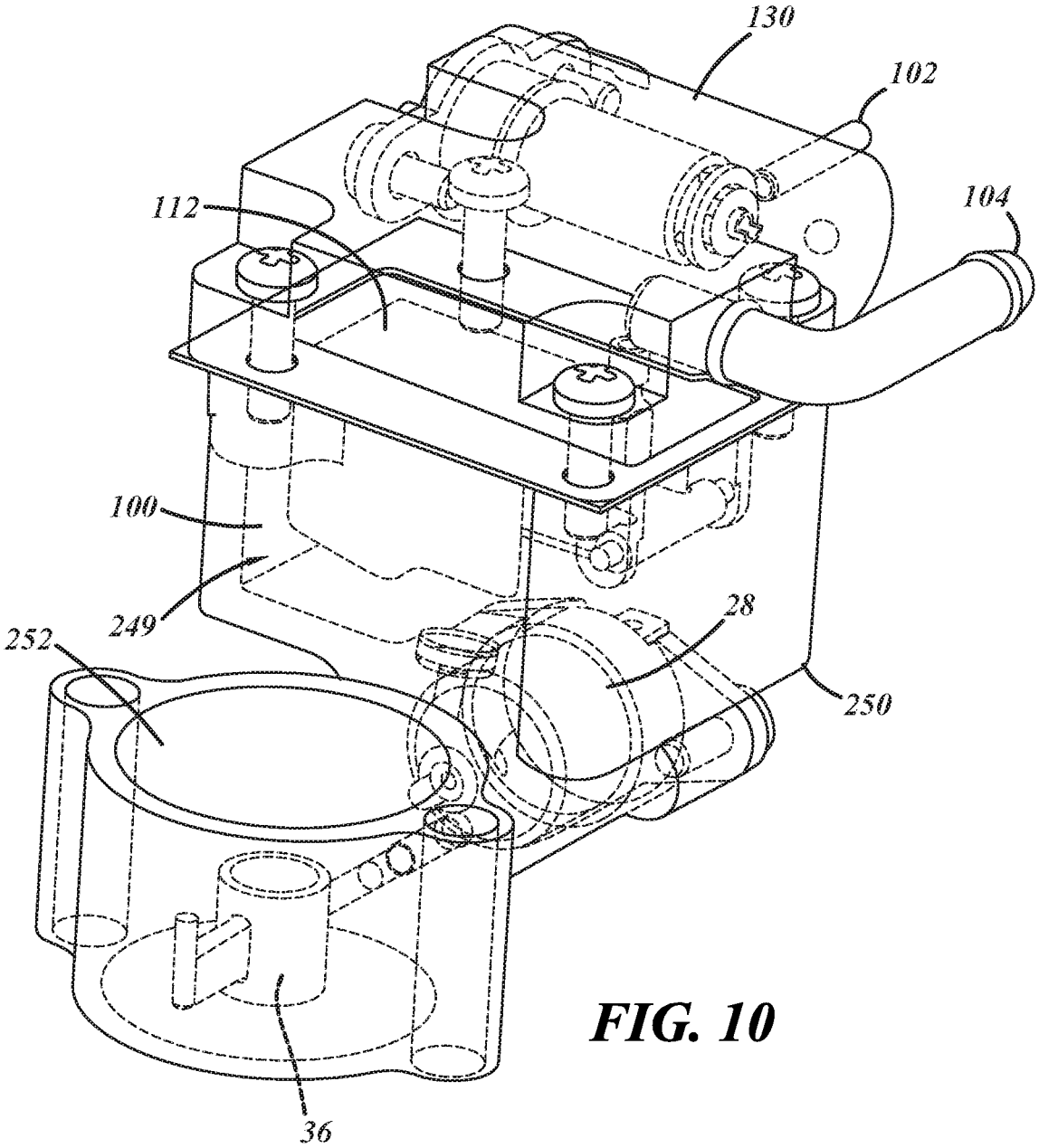
FIG. 10 is a perspective view of a vapor separator and fuel injection assembly that includes an intake manifold coupling portion or spacer.
Figure 11:
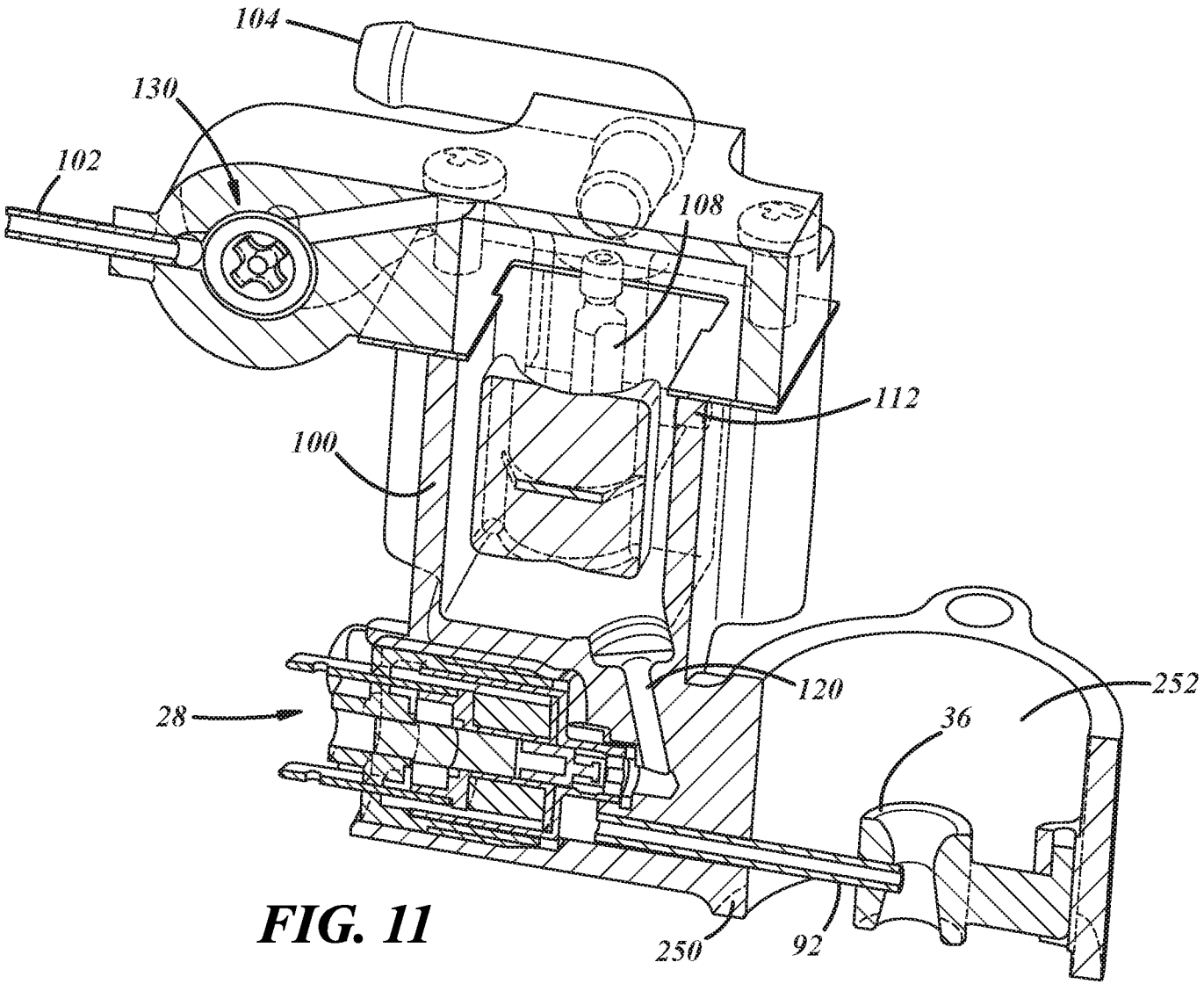
FIG. 11 is a sectional view of the assembly of FIG. 10.

In another example, as shown in FIGS. 10 and 11, a vapor separator 249 and at least one fuel injector 28 per intake runner or air/fuel passage 252, downstream of throttle valves (e.g. valves 52 in throttle body 206 shown in FIG. 7), may be provided in or carried by a body 250 that, in use, is mounted between the intake manifold 26 and an engine cylinder head, preferably close to the intake valve of the engine. The air/fuel passage 252 receives air from a throttle body or throttle valve assembly as noted above, and fuel from the inlet chamber 100 and fuel injector 28 is discharged into the air/fuel passage 252 for mixing with the air. A boost venturi 36 may optionally be provided within the air/fuel passage 252 of the body 250. Thus, instead of being built into the intake manifold 26, the body 250 is separate from the intake manifold and coupled thereto in assembly. Again, the vapor separator 249 and fuel injector(s) 28 may be constructed and function in the same manner as described above, if desired. Like the manifold 26 shown in FIGS. 7-9, the body 250 may include internal fuel passages (denoted by reference numeral 120 in FIG. 11) through which fuel is routed to and through the metering valve 28 and to the air/fuel passage 252, optionally inclusive of an outlet tube 92 and boost venturi 36, although fuel may flow directly into the air/fuel passage after exiting the fuel metering valve 28.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A throttle body assembly, comprising:
a body that has multiple throttle bores;
multiple throttle valve heads received one in each of the throttle bores;
at least one throttle valve shaft to which the throttle valve heads are coupled; and
at least one of a fuel metering valve and a vapor separator carried by the body.

2. The assembly of claim 1 wherein each valve head is coupled to the same throttle valve shaft.

3. The assembly of claim 1 which includes multiple fuel metering valves with one fuel metering valve provided for each throttle bore, and wherein each fuel metering valve is electrically actuated.

4. The assembly of claim 1 which includes multiple fuel metering valves with at least one fuel metering valve for each throttle bore, and wherein the vapor separator includes an inlet chamber defined at least partially within the body and having an inlet in communication with a fuel supply and an outlet in communication with each fuel metering valve.

5. The assembly of claim 4 wherein the inlet chamber includes at least one outlet and wherein each fuel metering valve is communicated with at least one outlet of the inlet chamber.

6. The assembly of claim 4 wherein fuel flows from the inlet chamber to the fuel metering valves at a pressure equal to or below 6 psi.

7. The assembly of claim 6 wherein fuel flows from the inlet chamber to the fuel metering valves under the force of gravity.

8. The assembly of claim 4 which also includes a vent valve having a closed position at least inhibiting flow therethrough and an open position in which gasses flow out of the inlet chamber.

9. The assembly of claim 8 which also includes a pressure sensor communicated with the inlet chamber and operable to provide a signal indicative of the pressure within the inlet chamber and wherein the vent valve is electrically actuated and controlled at least in part as a function of the pressure within the inlet chamber.

10. The assembly of claim 4 which also includes an inlet valve that is movable between closed and open positions to selectively permit fuel to enter the inlet chamber when the inlet valve is in the open position, and a float coupled to the inlet valve, the float being responsive to the level of liquid fuel to move the inlet valve to the closed position when a maximum fuel level is present within the inlet chamber.

11. The assembly of claim 10 wherein the inlet chamber is not completely full of liquid fuel at the maximum fuel level in the inlet chamber, leaving a space above the fuel level in which gasses are present.

12. The assembly of claim 2 which also includes at least one of an electrically controlled actuator that rotates the throttle valve shaft or a throttle position sensor that is responsive to the rotary position of the throttle valve shaft.

13. The assembly of claim 1 which also includes a boost venturi located within one of the multiple throttle bores, and wherein liquid fuel flows into the throttle bore through at least part of the boost venturi.

14. The assembly of claim 1 which includes at least one fuel metering valve and which also includes an air induction passage communicating with one of said multiple throttle bores and with said at least one fuel metering valve to provide a gaseous flow including air and/or fuel vapor that is mixed with fuel that flows through the fuel metering valve.

15. A manifold for an engine, comprising:

a body having an air/fuel passage through which fuel and air flow to the engine; and at least one of a fuel injector and a vapor separator carried by the body and through which liquid fuel is provided into the air/fuel passage.

16. The manifold of claim 15 wherein a vapor separator is carried by the body and the vapor separator includes an inlet chamber defined at least partially within the body and having an inlet in communication with a fuel supply and an outlet through which fuel is supplied to the air/fuel passage.

17. The manifold of claim 16 wherein a fuel injector is carried by the body and wherein the fuel injector has an inlet in communication with the inlet chamber and an outlet in communication with the air/fuel passage to provide fuel from the inlet chamber into the air/fuel passage when a valve of the fuel injector is in an open position.

18. The manifold of claim 15 which also includes a throttle body coupled to the body and having a throttle bore communicated with the air/fuel passage, the throttle body including at least one throttle valve in the throttle bore to control air flow through the throttle bore.

19. An assembly to provide fuel to an engine, comprising:

a body adapted to be coupled to an intake manifold, the body including an air/fuel passage through which air flows to the intake manifold;

a fuel injector carried by the body and communicated with the air/fuel passage to provide fuel into the air/fuel passage; and a fuel/vapor separator carried by the body and including a volume of fuel that is communicated with the fuel injector.

20. The assembly of claim 19 which also includes a throttle body located upstream of the body and having a throttle bore communicated with the air/fuel passage, the throttle body including at least one throttle valve in the throttle bore to control air flow through the throttle bore whereby the air flow from the throttle bore is combined with fuel flow from the fuel injector in the air/fuel passage.

* * * * *